US006412323B2

(12) United States Patent
Dicke et al.

(10) Patent No.: US 6,412,323 B2
(45) Date of Patent: Jul. 2, 2002

(54) CROSS-ROLL STRAIGHTENER

(75) Inventors: Jochen Dicke, Gevelsberg; Franz Stehr, Bergisch-Gladbach, both of (DE)

(73) Assignee: SMS Eumuco GmbH, Leverkusen (DE)

( * ) Notice: Subject to any disclaimer, the term of this patent is extended or adjusted under 35 U.S.C. 154(b) by 0 days.

(21) Appl. No.: 09/755,604

(22) Filed: Jan. 5, 2001

(30) Foreign Application Priority Data

Jan. 7, 2000 (DE) ..... 100 00 349

(51) Int. Cl.[7] ..... B21B 19/02
(52) U.S. Cl. ..... 72/99; 72/244
(58) Field of Search ..... 72/95, 98, 99, 72/244, 245, 248

(56) References Cited

U.S. PATENT DOCUMENTS 3,626,732 A * 12/1971 Krafft et al. ..... 72/99
4,406,141 A * 9/1983 Numano et al. ..... 72/99
4,471,639 A * 9/1984 Gerber ..... 72/99
4,989,432 A * 2/1991 Taylor et al. ..... 72/99

FOREIGN PATENT DOCUMENTS

DE 19 10 879 9/1970
SU 1507493 * 9/1989 ..... 72/99

* cited by examiner

*Primary Examiner*—Ed Tolan
(74) *Attorney, Agent, or Firm*—Herbert Dubno

(57) ABSTRACT

A cross-roll straightener for blank and black stock, especially rounds, in which the upper roll is mounted on a roll bed guided on columns of the machine frame via adjusting devices. Two diagonally opposite devices have hydraulically-controlled wedges and a threaded spindle controlling the vertical movement of the roll bed is also provided with a hydraulic arrangement for blocking spindle mobility.

10 Claims, 6 Drawing Sheets

CROSS-ROLL STRAIGHTENER

FIELD OF THE INVENTION

Our present invention relates to a cross-roll straightener and, more particularly, a straightener for bar stock, blanks and the like in which a lower roll and an upper roll have their axes crossing and the angle formed by these axes about a vertical axis is adjustable.

BACKGROUND OF THE INVENTION

German patent document DE-AS 19 10 879 discloses a cross-roll or inclined-roll straightener which is comprised of a lower yoke, an upper yoke and columns connecting these yokes into a mill frame. The upper and lower rolls are journaled in roll frames on the lower and upper yokes and the roll frame on the upper yoke can be adjusted relative to the roll frame and the lower yoke by an adjusting spindle in the vertical direction. Means is provided, in addition, for adjusting the cross angle of the roll axes about the vertical central axis of the straightener.

In this patent document, the lower yoke is provided with a vertically-movable slider which is actuated by a piston and cylinder unit. For the straightening of so-called blank stock (drawn, peeled or bright rounds or bar stock) the roll frame carrying the lower roller is braced directly on the lower beam or yoke of the frame. For the straightening of so-called black stock (unworked bars with incompletely round cross sections), the piston and cylinder unit is actuated with an adjustable pressure to lift the slider carrying the lower roller from its abutment with the lower yoke or beam and a yieldable bracing of the lower roll takes over. During the introduction and discharge of a bar to be straightened, the roll or straightening gap can be opened by pressure relief of the piston-cylinder unit. The yieldable bracing provides protection against overloading.

In the inclined-roll straightening technique, reaction forces of varying magnitude act upon the rollers which produce transverse forces and torques upon the roller frames about the vertical axis. These forces and torques must be taken up directly by the lower yoke for the lower roller and by the upper yoke and the columns of the press frame for the upper roll. When the upper roll in such a straightening machine is advantageously mounted in a bed received between the yokes and guided in the press frame, these considerations apply between the bed and the columns depending upon the play. Countering these phenomena may be a readjustment of the bracing of the upper roll for the straightening of black stock as a consequence of the non-round character thereof and the diameter differences.

OBJECTS OF THE INVENTION

It is, therefore, an object of the invention to provide an improved inclined-roll or cross-roll straightening machine of the aforedescribed type so that both blank stock and black stock be effectively straightened without drawbacks of the type which now characterized such machines.

Another object of the invention is to provide an improved cross-roll or inclined-roll straightening whereby problems which have hitherto been encountered in utilizing the columns of the machine for guidance purpose can be obviated.

SUMMARY OF THE INVENTION

These objects are attained, in accordance with the invention in a cross-roll straightening which comprises:

a frame comprising a lower yoke, an upper yoke, and four vertical columns at corners of a rectangle connected between the yokes;

a lower roll mounted on the lower yoke;

a roll bed vertically shiftable on the upper yoke;

an upper roll mounted on the roll bed and cooperating with the lower roll and having a roll axis crossing a roll axis of the lower roll for straightening stock passed through a gap between the rolls in a feed direction, the roll axes being at an angle to one another about a vertical axis;

a spindle and nut device between the roll bed and the upper yoke for vertically positioning the upper roll relative to the lower roll;

a respective vertical guide track formed on each of the columns and respective guide surfaces on the roll bed riding on each vertical guide track;

a respective adjusting device between each column and the respective guide track, the adjusting devices including a pair of upstream adjusting devices and a pair of downstream adjusting devices with respect to the direction, one of the adjusting devices of each pair being a hydraulic adjusting device with a respective double-acting adjusting hydraulic cylinder and the other adjusting device of each pair being a mechanical adjusting device, the adjusting devices rotating the bed about the vertical axis to vary the angle; and a further double-acting hydraulic cylinder on the upper yoke for applying axial stress to and relieving axial stress on the spindle and nut device.

More particularly, the upper roll is mounted on a roll bed constituting a member received between the upper and lower yokes within the frame formed by these yokes and the columns and has four guide surfaces which slide along guide tracks on the column which can be adjusted by positioning wedges, shimming bars and like adjusting devices and these adjusting devices are provided in pairs. One pair of adjusting devices is relatively upstream and the other pair is relatively downstream with respect to the direction of displacement of the stock through the apparatus and between the rolls.

According to the invention, one of the adjusting devices of each pair has its adjusting wedge hydraulically displaceable by a double-acting piston-cylinder unit whereas the other adjusting wedge of that pair is mechanically adjustable. The roll bed is connected to the yoke in that it has a hollow pin for a guidance in the upper yoke and formed with a threaded nut engageable by a threaded spindle on the yoke. This adjustment spindle, in turn, is braced axially by a double-acting piston and cylinder unit which, when it generates forces, prevents the spindle from rotating in the nut.

These features ensure that with a simple hydraulic cylinder control, a prestressing of the straightening machine can be effected with a clamping of the guide plane, especially for the straightening of blank material, so that the rolls and their supports are braced rigidly with respect to one another. It also allows a floating support for the upper roll with adjustable straightening pressure or play for the straightening of black stock. A double-acting piston and cylinder unit for the spindle and nut between the roll bed and the upper yoke serves to take up any play in the mutually-engaging threads of the spindle and yoke.

According to a preferred feature of the invention, the stressing piston and cylinder unit acting on the spindle and the piston and cylinder unit for hydraulically displacing adjusting wedges are simultaneously supplied with maximum pressure. In this state, the straightening machine is rendered free from any play and is under maximum prestress so that the straightening machine can operate with the straightening gap height determined by the spindle. With simultaneous shifting of the positioning wedges, any play in the displacement of the roll bed can be reduced to zero and blank stock can be reliably straightened.

The clamping piston and cylinder unit of the adjusting spindle can have maximum pressure applied thereto while the piston and cylinder unit of the hydraulically actuated wedges can be pressureless. This allows straightening of blank stock without active clamping of the lower plane, i.e. with a minimum adjustable play.

The invention affords however an alternative operation in that with a straightening gap which is smaller than the diameter of the stock to be straightened, the stressing piston and cylinder unit can allow a floating of the spindle while the piston and cylinder units of the hydraulic wedges are relieved of pressure. This provides the conditions necessary for the straightening of black stock whereby the straightening gap is smaller by an amount, say, of x than the actual diameter of the straightened stock.

The stressing piston and cylinder unit then permits a floating of the bed by a magnitude x and compensates for the deviation between the gap width and the diameter of the stock to be straightened. Since, in this case, the lower guide plane, i.e. the roll bed, can be displaced without active clamping by the adjustment wedges, the roll bed can make up for the difference x. The play permitted the roll bed can be adjusted by the adjustment screws of the mechanically-shiftable wedges.

A pressure-limiting valve can be provided on the pressure side of the system supplying the stressing piston and cylinder unit such that a fallback counter to the straightening force is possible.

According to a feature of the invention, on the upper yoke a further piston and cylinder unit can be provided to act upon the roll bed via a tension bar.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
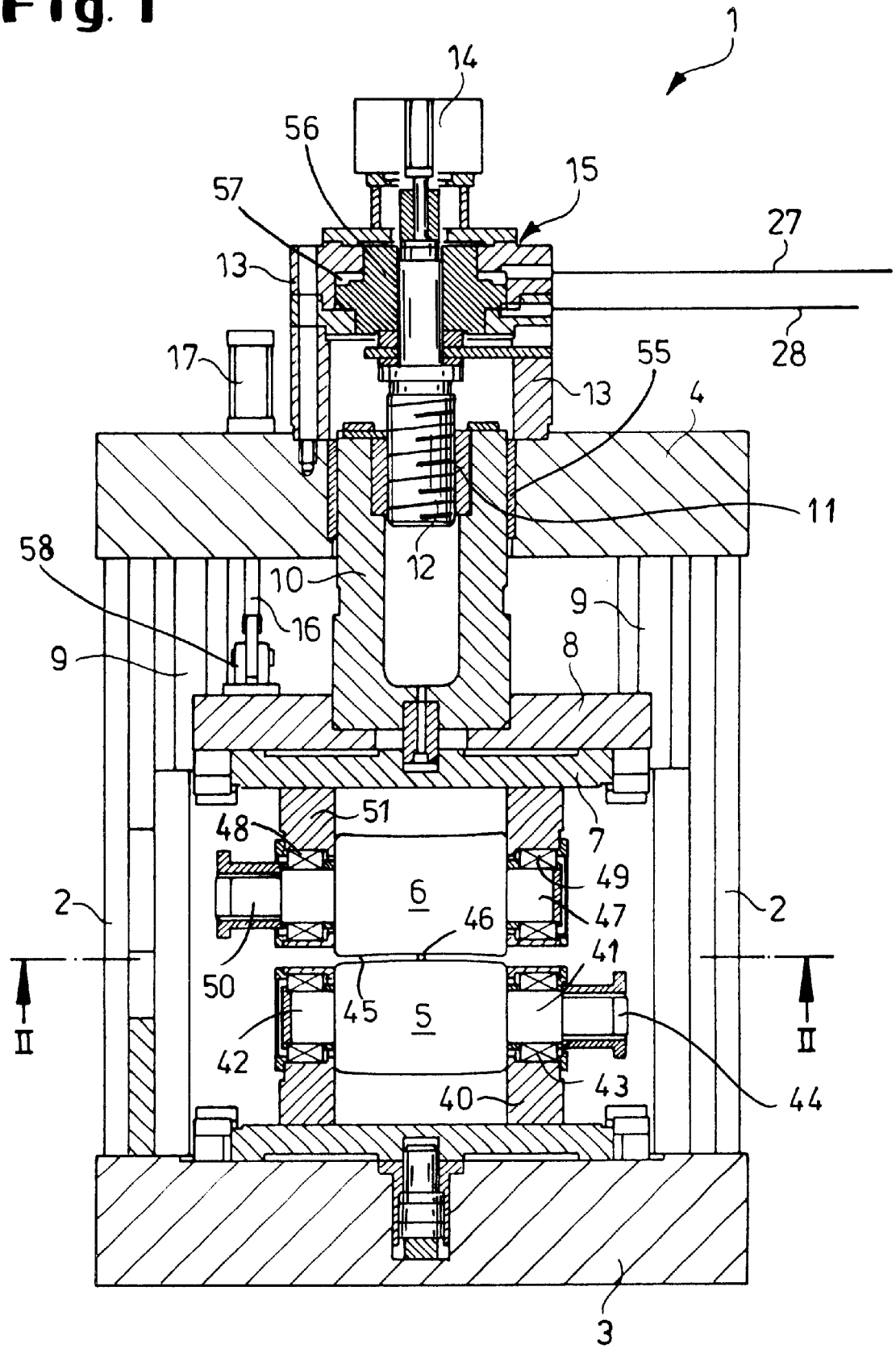
FIG. 1 is a vertical section through a cross-roll straightening machine according to the invention.

FIG. 1 shows the cross-roll straightening machine 1 which comprises four guide posts for columns 2 connecting a lower yoke or beam 3 and an upper yoke or beam 4. On the lower yoke 3, in a yoke frame 40 there is journaled a lower roll 5 which is formed as a convex roll whose shaft stubs 41 are journaled in bearings 42 and 43. One stub 41 may have an extension 44 at which a drive can be coupled to that roll. The roll gap is represented at 45 and the rolled stock can be seen at 46.

The upper roll 6 is a convex roll and has its stub shafts 47 journaled in bearings 48 and 49 and is also provided with an extension 50 connectable to a drive. The bearings are mounted in a roll frame 51 connected to a support 7 which can be attached, in turn, to a roll bed 8 guided by tracks 9 on the column 2 (see also FIG. 2).

Figure 1A:
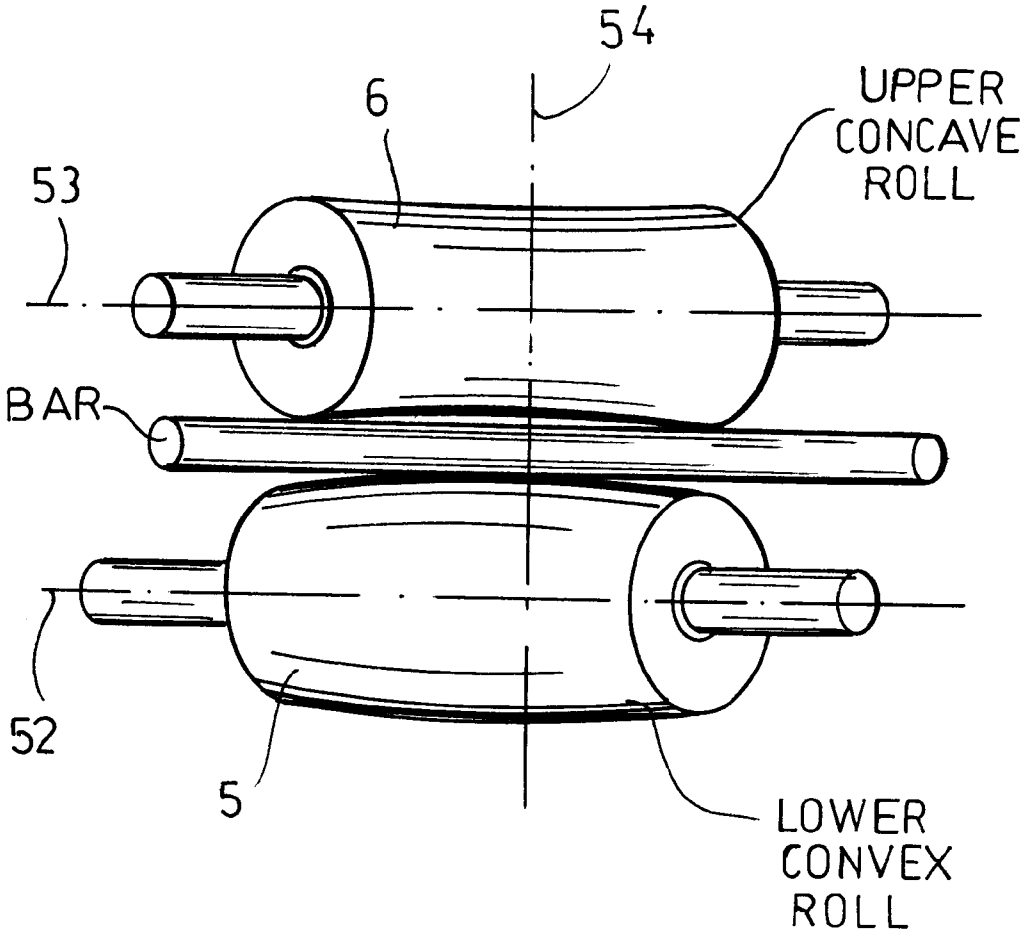
FIG. 1A is a diagram showing the relationship between the axes of the rolls.

As will be apparent from FIG. 1A, the rolls 5 and 6 have axes 52 and 53 which lie in different horizontal planes, but which are crossing, i.e. define an angle with one another with respect to a vertical central axis 54 of the machine. That axis can be adjusted according to the invention as can the width of the gap 45 as the description will show below.

From FIG. 1 it will also be apparent that the roll bed 8 is formed with a hollow pin 10 which extends into the yoke 4 and is guided therein, e.g. by an antifriction layer 55. The hollow pin is formed internally with a threaded nut 11 engaging a threaded spindle 12. This is secured in a bracket 11 mounted on the upper yoke and provided with an adjustment unit 14, for example, a motor-driven worm and worm wheel which can rotate the threaded spindle 12.

Figure 2:
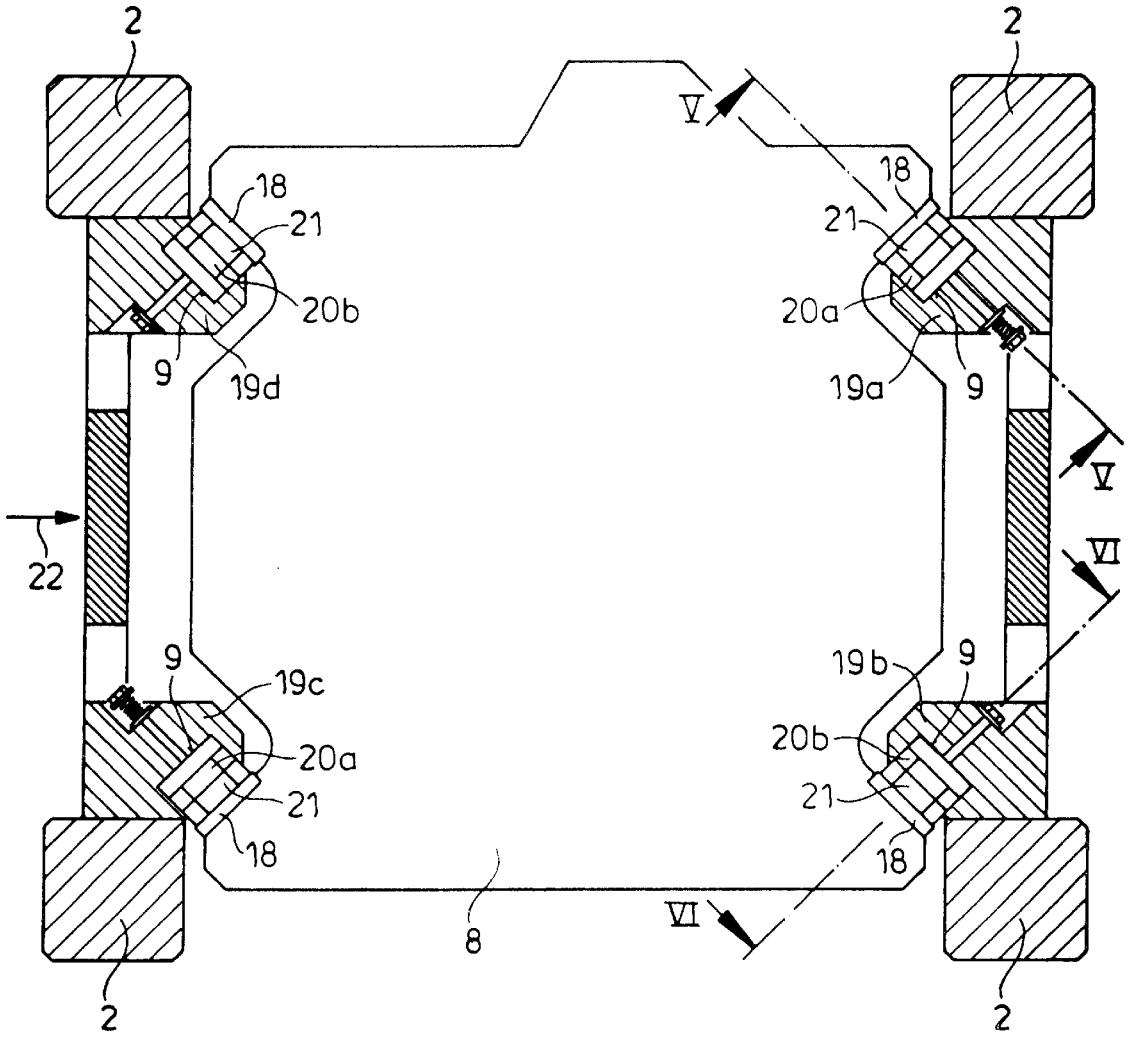
FIG. 2 is a section along line II—II through a cross-roll straightening machine of the type shown in FIG. 1 and simplified by omitting the upper roll arrangement.

Within the bracket 13, moreover, a stressing piston and cylinder unit 15 is provided with, for example, the piston 56 and the cylinder 57. This unit is double-acting for the elimination of play between the nut 11 and the spindle 12, the roll bed 8 is also connected to the yoke 4 by a cylinder 17 whose piston is connected by a tension bar 16 with the roll bed 8 at a pivot 58. The roll bed 8 is, as can be seen from FIG. 2, provided with V-shaped cutouts at its corners and is formed at these cutouts with guide surfaces 18 juxtaposed with the guide tracks 9. The guide tracks are formed in mounting blocks 19*a*–19*d* (FIG. 2) attached on the posts or columns 2.

Figure 5:
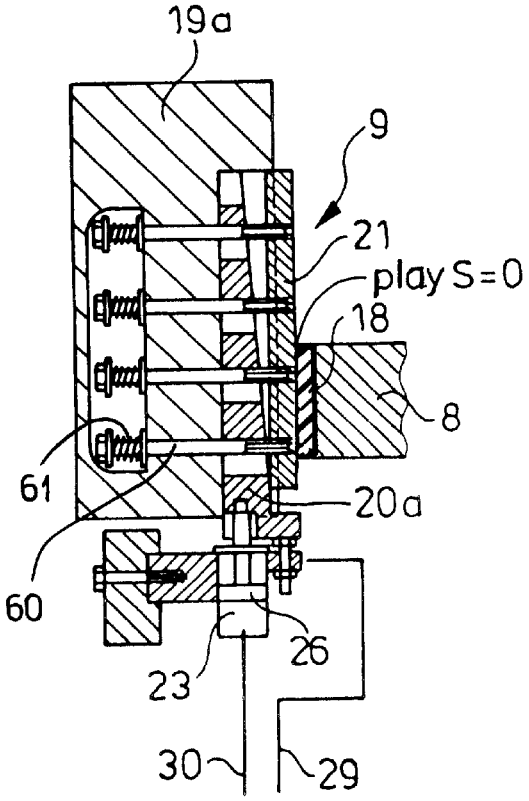
FIG. 5 is a detail corresponding to a section through the guide track along the line V—V in FIG. 2.
Figure 6:
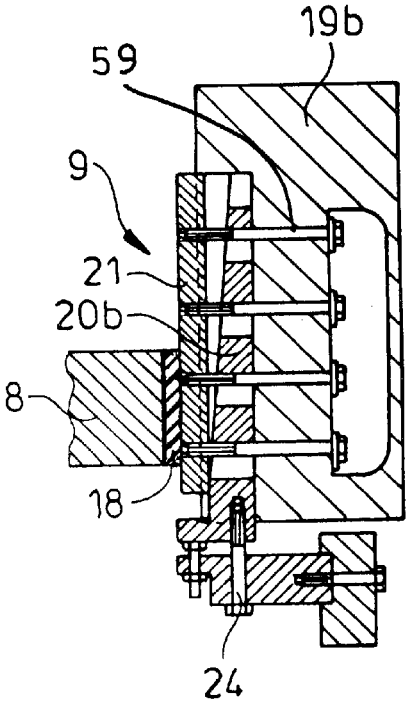
FIG. 6 is a detail of FIG. 2 seen in section along the line VI—VI thereof.
Figure 7:
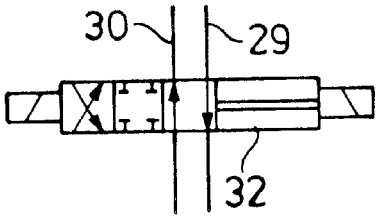
FIG. 7 is an illustration of the four-port three-position valve for hydraulic control in FIG. 5, for example, in a first operating position.
Figure 8:
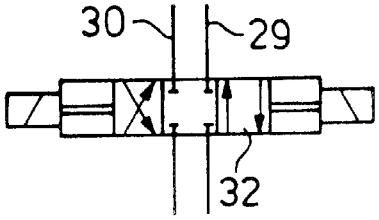
FIG. 8 is a view similar to FIG. 7 showing the same valve in a second operating position.

The guide tracks, as can be seen especially from FIGS. 5 and 6 can each have a setting wedge 20*a* and 20*b* braced between the respective block 19*a*, 19*b* and a complementary bar 21 which is drawn toward the wedge by bolts 59 or 60. The bolts 59 allow no yieldability for the mechanical adjusting device as shown in FIG. 6. However, the bolts 60 bear upon springs 61 and thus are limitedly yieldable. The roll bed 8 is provided with an antifriction liner 18 which permits sliding along the bars 21 which form the tracks 9.

As can be seen from FIG. 2, the bar stock, e.g. round 46, is fed between the rolls in the direction of arrow 22 between front and rear frame columns. The adjustment devices are subdivided into two pairs which are relatively upstream and downstream with respect to the direction 22. One of these adjustment devices, namely, that provided with the wedge 20*a*, can be actuated by a double-acting piston and cylinder unit 23 (FIG. 5) while the other wedge 20*b* is adjustable by a screw 24 (FIG. 6). While the wedge 20*b* can be adjusted into a fixed position, the wedge 20*a* is hydraulically displaceable (FIG. 2) so that two diagonal adjustment devices permit hydraulic actuation.

Figure 3:
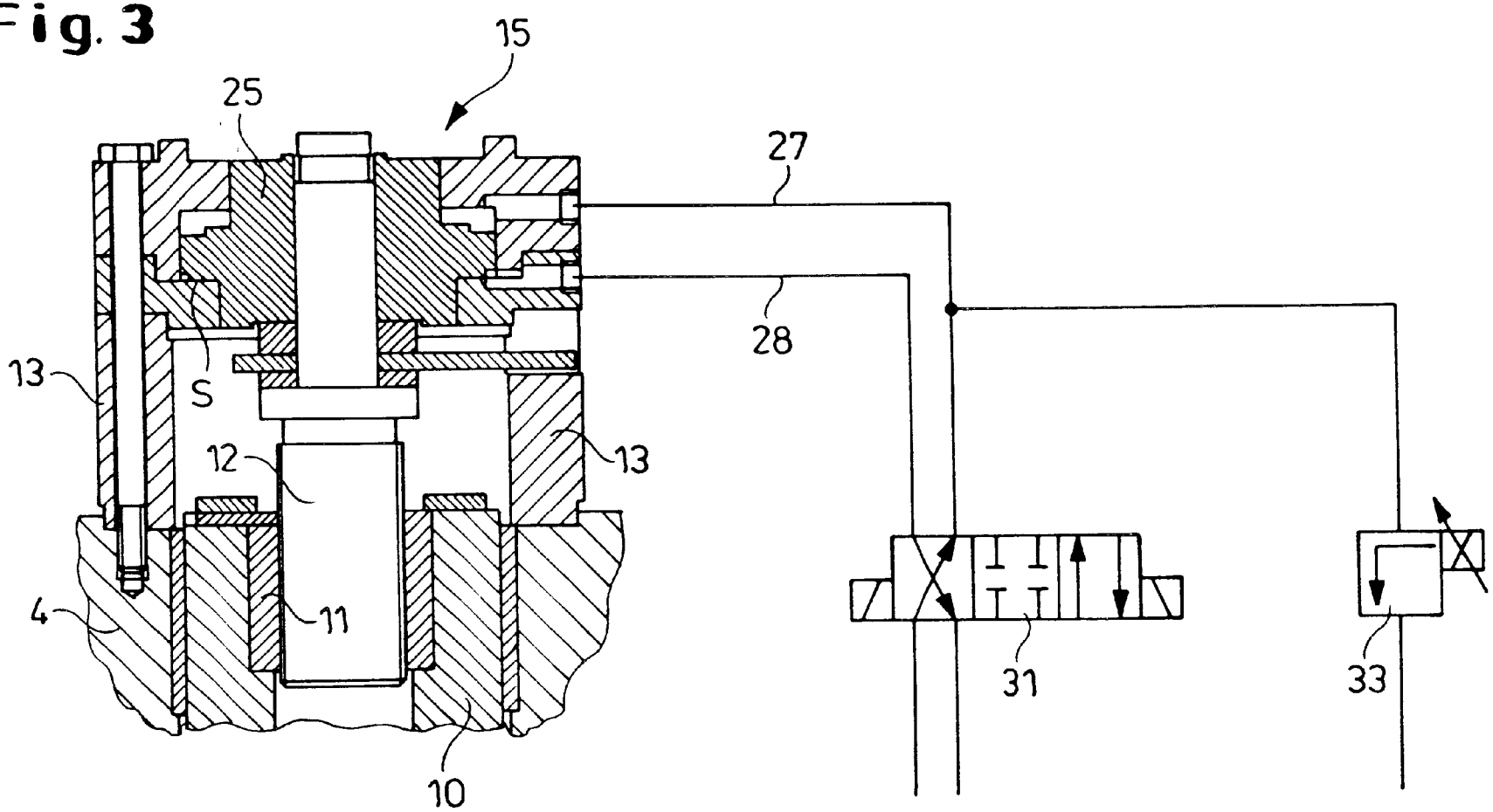
FIG. 3 is a detail of the stressing piston and cylinder unit on the upper yoke of FIG. 1 in a first operating position.
Figure 4:
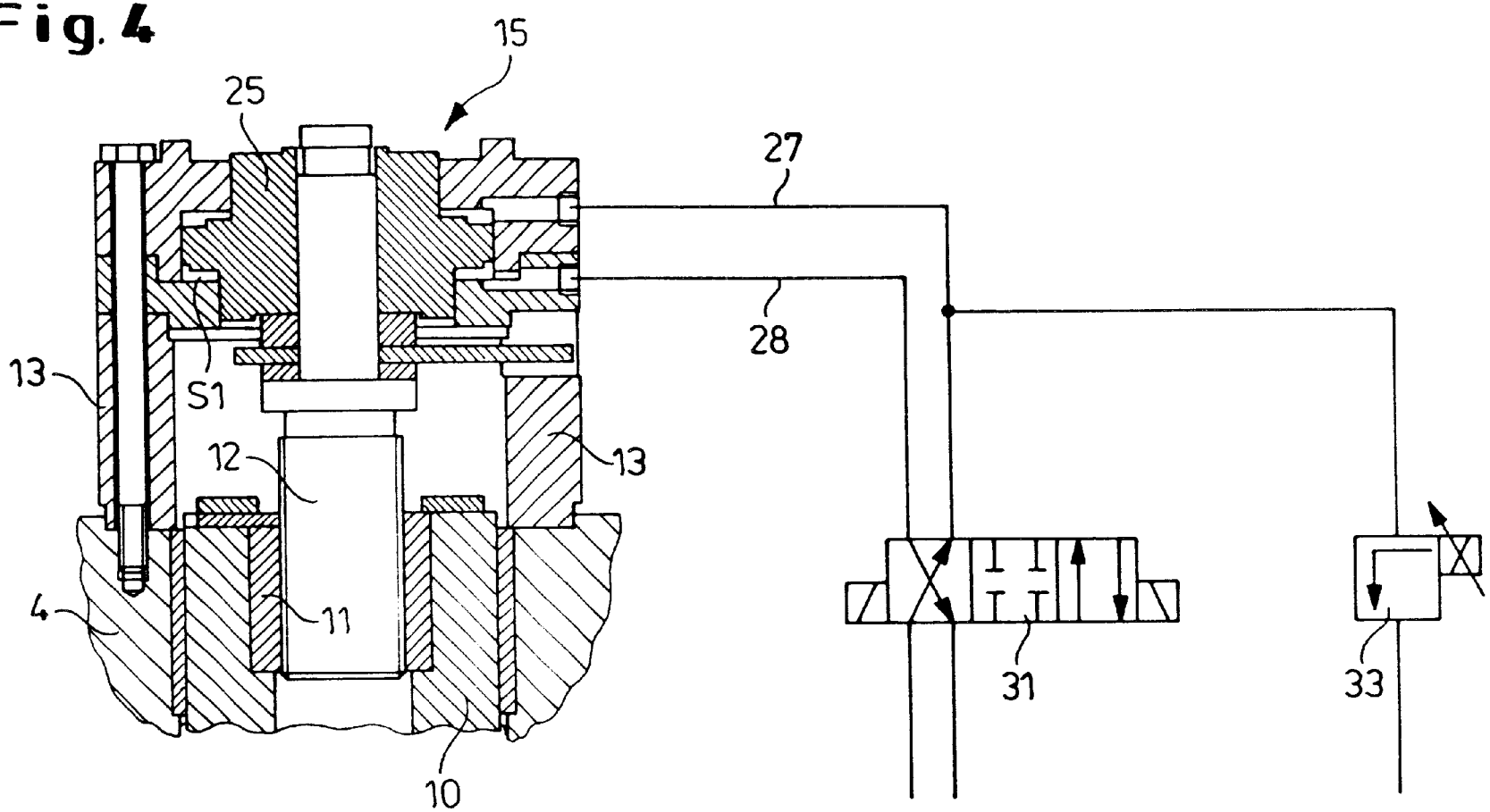
FIG. 4 is a view similar to FIG. 3 showing the piston and cylinder unit in a further operating position.

For control of the stressing piston and cylinder unit 15 and the wedge-operating piston and cylinder units 23 for the wedges 20*a*, as is required to switch over from blank stock operation to black stock operation, the hydraulic system shown in FIGS. 3 and 4 can be provided. To this end, the piston 25 is exposed on opposite sides to the hydraulic pressures in lines 27 and 28 while the pistons 26 of the units 23 are subjected on opposite sides to the pressures in lines 29 and 30 (see FIGS. 3, 5, 7 and 8) connected via the multipath valve 31 or 32 to a hydraulic pressure source and a control unit. At the pressure side of the stressing piston and cylinder unit 15, an adjustable pressure-limiting valve 33 is provided.

For straightening of blank stock, the straightening gap between the rolls 5 and 6 is set by the threaded spindle 12 and the latter is then stressed so as to be nonyieldable by the hydraulic cylinder arrangement 15 which is then energized with a hydraulic pressure Pmax, eliminating all play as represented by S=0 (see FIGS. 3 and 5). In addition the piston and cylinder units 23 or the hydraulically-operated wedges 20*a* are so shifted that the play here is zero as well. As a consequence the assembly of the roll bed 8, the guide tracks 9 and upper yoke 4 constitutes a rigid block. The multipath valve 32 is in its position shown in FIG. 7 for this purpose. The blank stock is then composed through the straightener gap 45 which is fixed.

In the straightening of black stock, by contrast, in which the straightening gap 45 is to be smaller by the amount x than the actual diameter of the stock 46 to be straightened, the multipath valve 31, 32 is switched. The piston 25 is brought into intermediate position shown in FIG. 4 for the piston and cylinder unit 15 in which it is blocked at a location in which a gap S1 is formed between the bottom of the piston and the cylinder wall. Depending upon the magnitude of the gap S1, which can correspond to the amount x, the piston 45 can float to allow compensation, during the straightening, for deviations in the stock diameter and deviations in the shape of the black stock. The valve 32 is then in a position shown in FIG. 8 which ensures that the wedges 20*a* will be relieved from clamping against the roll bed. The roll bed 8 is then guided primarily by the other pair of adjusting devices, controlled by the screws 24, and with some play.

We claim:

1. A cross-roll straightener comprising:

a frame comprising a lower yoke, an upper yoke, and four vertical columns at corners of a rectangle connected between said yokes;

a lower roll mounted on said lower yoke;

a roll bed vertically shiftable on said upper yoke;

an upper roll mounted on said roll bed and cooperating with said lower roll and having a roll axis crossing a roll axis of said lower roll for straightening stock passed through a gap between said rolls in a feed direction, said roll axes being at an angle to one another about a vertical axis;

a spindle and nut device between said roll bed and said upper yoke for vertically positioning said upper roll relative to said lower roll;

a respective vertical guide track formed on each of said columns and respective guide surfaces on said roll bed riding on each vertical guide track;

a respective adjusting device between each column and the respective guide track, the adjusting devices including a pair of upstream adjusting devices and a pair of downstream adjusting devices with respect to said direction, one of the adjusting devices of each pair being a hydraulic adjusting device with a respective double-acting adjusting hydraulic cylinder and the other adjusting device of each pair being a mechanical adjusting device, said adjusting devices rotating said bed about said vertical axis to vary said angle; and a further double-acting hydraulic cylinder on said upper yoke for applying axial stress to and relieving axial stress on said spindle and nut device.

2. The cross-roll straightener defined in claim 1, further comprising a piston and cylinder unit on said upper yoke, operatively connected with said roll bed for taking up play in said spindle and nut device.

3. The cross-roll straightener defined in claim 2 wherein said hydraulic cylinders are provided with a hydraulic medium control system by which the further double-acting hydraulic cylinder and the adjusting hydraulic cylinders are simultaneously supplied with hydraulic medium at maximum pressure.

4. The cross-roll straightener defined in claim 2 wherein said hydraulic cylinders are provided with a hydraulic medium control system by which the adjusting hydraulic cylinders are devoid of pressure when said further double-acting hydraulic cylinder is pressurized at maximum pressure.

5. The cross-roll straightener defined in claim 2 wherein said rolls have a roll gap which is smaller than a diameter of said stock and said hydraulic cylinders are provided with a hydraulic medium control system enabling said further double-acting hydraulic cylinder to be energized with hydraulic medium to permit floating of said spindle when said adjusting hydraulic cylinders are devoid of pressure.

6. The cross-roll straightener defined in claim 2 wherein said further double-acting hydraulic cylinder is provided with a hydraulic actuating system having a pressure side for a hydraulic medium supply provided with an adjustable pressure-limiting valve.

7. The cross-roll straightener defined in claim 1 wherein said hydraulic cylinders are provided with a hydraulic medium control system by which the further double-acting hydraulic cylinder and the adjusting hydraulic cylinders are simultaneously supplied with hydraulic medium at maximum pressure.

8. The cross-roll straightener defined in claim 1 wherein said hydraulic cylinders are provided with a hydraulic medium control system by which the adjusting hydraulic cylinders are devoid of pressure when said further double-acting hydraulic cylinder is pressurized at maximum pressure.

9. The cross-roll straightener defined in claim 1 wherein said rolls have a roll gap which is smaller than a diameter of said stock and said hydraulic cylinders are provided with a hydraulic medium control system enabling said further double-acting hydraulic cylinder to be energized with hydraulic medium to permit floating of said spindle when said adjusting hydraulic cylinders are devoid of pressure.

10. The cross-roll straightener defined in claim 1 wherein said further double-acting hydraulic cylinder is provided with a hydraulic actuating system having a pressure side for a hydraulic medium supply provided with an adjustable pressure-limiting valve.

* * * * *